US007681968B2

(12) United States Patent
Jung et al.

(10) Patent No.: US 7,681,968 B2
(45) Date of Patent: Mar. 23, 2010

(54) INK LEVEL DETECTING APPARATUS OF AN INK-JET PRINTER

(75) Inventors: Dong-kee Jung, Seoul (KR); Jae-cheol Lee, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 281 days.

(21) Appl. No.: 11/453,142

(22) Filed: Jun. 15, 2006

(65) Prior Publication Data

US 2007/0002086 A1 Jan. 4, 2007

(30) Foreign Application Priority Data

Jul. 4, 2005 (KR) ..... 10-2005-0059667

(51) Int. Cl.
*B41J 2/195* (2006.01)

(52) U.S. Cl. ..... 347/7

(58) Field of Classification Search ..... 347/7
See application file for complete search history.

(56) References Cited

U.S. PATENT DOCUMENTS 4,604,633 A 8/1986 Kimura et al.
5,731,824 A 3/1998 Kneezel et al.
6,641,240 B2 * 11/2003 Hsu et al. ..... 347/7

FOREIGN PATENT DOCUMENTS

| | | |
|---|---|---|
| EP | 0 718 104 A1 | 6/1996 |
| JP | 06-143612 | 5/1994 |
| KR | 1999-006632 | 1/1999 |

* cited by examiner

*Primary Examiner*—Julian D Huffman
(74) *Attorney, Agent, or Firm*—Stanzione & Kim LLP

(57) ABSTRACT

An ink level detecting apparatus usable with an ink-jet printer includes an ink tank having a bottom, a ceiling, and a sidewall, a shrinkable ink pack is accommodated in the ink tank and having a top surface that moves down evenly as an ink level in the shrinkable ink pack decreases, a fixed electrode installed to an upper portion of the ink tank, and a movable electrode disposed to face the fixed electrode at a predetermined distance from the fixed electrode. The movable electrode moves in a horizontal direction according to a height variation of the top surface of the shrinkable ink pack such that an overlap area between the movable electrode and the fixed electrode varies. Therefore, the ink level is detected from electric capacity variation sensed between the fixed electrode and the movable electrode.

30 Claims, 4 Drawing Sheets

INK LEVEL DETECTING APPARATUS OF AN INK-JET PRINTER

CROSS-REFERENCE TO RELATED APPLICATIONS

This application claims the benefit of Korean Patent Application No. 2005-59667, filed on Jul. 4, 2005, in the Korean Intellectual Property Office, the disclosure of which is incorporated herein in its entirety by reference.

BACKGROUND OF THE INVENTION

1. Field of the Invention

The present general inventive concept relates to an ink level detecting apparatus of an ink-jet printer, and more particularly, to an ink level detecting apparatus that utilizes a shrinkable ink pack having a height that varies according to an amount of remaining ink and a capacitor having an electric capacity that varies in response to the height variation of the shrinkable ink pack.

2. Description of the Related Art

In typical ink-jet printers, ink is supplied from an ink tank through an ink supplying passage to an ink ejection unit having an ink-jet head, and droplets of the ink are ejected through the ink-jet head. Therefore, ink level in the ink tank is lowered as printing progresses.

In the ink-jet printers, an amount of remaining ink (i.e., the ink level) in the ink tank should be measured somewhat precisely. In particular, when the ink level approaches a minimum level (that is, when the amount of remaining ink is insufficient), a user is not informed of this condition, and a next page cannot be printed for the following reasons.

First, if the ink is ejected until it is used up, the ink-jet head can be damaged. For example, according to one method of ejecting ink, a heating unit applies heat to the ink contained in an ink cell to eject the ink by rapidly expanding the ink. In this case, if the heating unit operates when the ink is not remaining in the ink cell, the heating unit or other parts around the heating unit can be damaged. Therefore, whether the ink reaches the minimum level should be reliably so as to prevent damaging of the ink-jet head.

Second, if the ink is used up before a current page is not yet completely printed, the current sheet of paper and the ink on the paper are wasted. Therefore, it must be detected whether the amount of ink for printing at least one page is remaining or not.

For these reasons, several ink level detecting apparatuses have been developed. For example, an ink level detecting apparatus that utilizes a capacitor having an electric capacity that varies depending on the ink level is described in U.S. Pat. No. 4,604,633 entitled "Ink-jet recording apparatus." According to the ink-level detecting apparatus, an upper electrode and a lower electrode are respectively provided on an upper inner wall and a lower inner wall of an ink cartridge to face each other. An ink pack is interposed as an intermediate material between the two electrodes, thereby forming the capacitor. The ink pack shrinks as the ink therein is consumed, and the electric capacity of the capacitor varies in proportion to the shrinkage of the ink pack. Therefore, the ink level can be detected by measuring the variation of the electric capacity.

However, according to the ink-level detecting apparatus described above, a distance between the two electrodes (i.e., the upper and lower electrodes) is too large to obtain a signal having a sufficient intensity. Further, it is assumed that an area of the ink pack formed of a flexible film decreases approximately in proportion to the amount of ink used. However, not only the area of the ink pack but also the height of the ink pack changes according to the use of the ink. That is, the distance between the upper electrode and the lower electrode changes according to the use of the ink. Since the electric capacity between the two electrodes is affected by the distance between the two electrodes more than the area of overlap between the two electrodes, an irregular height variation of the ink pack affects the electric capacity significantly. Therefore, there is a problem in that it is difficult to implement the apparatus described above, and even if the apparatus is implemented, the ink level cannot be detected reliably.

SUMMARY OF THE INVENTION

The present general inventive concept provides an ink level detecting apparatus that utilizes a shrinkable ink pack having a height that is lowered in response to ink consumption to detect an ink level in an ink tank by using an electrical signal generated in an approximately linear proportion to the height variation of the shrinkable ink pack in the ink tank. Therefore, an ink-jet head can be protected, and waste of the ink can be prevented.

The present general inventive concept also provides an ink detecting apparatus that uses a stepped electrical signal generated according to height variation of a shrinkable ink pack to simply detect an ink level without comparison to a sensed signal.

Additional aspects of the present general inventive concept will be set forth in part in the description which follows and, in part, will be obvious from the description, or may be learned by practice of the general inventive concept.

The foregoing and/or other aspects of the present general inventive concept may be achieved by providing an ink level detecting apparatus usable with an ink-jet printer, including an ink tank including a bottom, a ceiling, and a sidewall, a shrinkable ink pack accommodated in the ink tank and including a top surface that moves down evenly as an ink level therein decreases, a fixed electrode disposed on an upper portion of the ink tank, and a movable electrode attached to the top surface of the ink pack and disposed to face the fixed electrode at a predetermined distance from the fixed electrode to move in a horizontal direction according to a height variation of the top surface of the shrinkable ink pack such that an overlap area between the movable electrode and the fixed electrode varies, wherein the ink level is detected from an electric capacity variation sensed between the fixed electrode and the movable electrode.

The foregoing and/or other aspects of the present general inventive concept may also be achieved by providing an ink level detecting apparatus usable in an image forming device, the apparatus including an ink tank having a shrinkable ink container containing ink, a first electrode disposed on a first inner wall of the ink tank opposite the ink container, and a second electrode attached to the shrinkable ink container opposite the first electrode such that the second electrode is movable with respect to the first electrode as an amount of ink contained in the ink container decreases.

The foregoing and/or other aspects of the present general inventive concept may also be achieved by providing an ink level detecting apparatus usable with an ink-jet printer, including an ink tank having a bottom, a ceiling, and a sidewall, a shrinkable ink pack accommodated in the ink tank and including a top surface that moves down evenly as an ink level in the shrinkable ink pack decreases, a fixed electrode disposed on an upper portion of the ink tank, and a movable electrode attached to the top surface of the ink pack and disposed to face the fixed electrode at a predetermined distance from the fixed electrode to move in a horizontal direction according to the height variation of the top surface of the shrinkable ink pack such that an overlap area between the movable electrode and the fixed electrode varies, wherein one of the fixed electrode and the movable electrode is divided into a plurality of insulated regions such that a number of the regions overlapping with the other electrode varies depending on the movement of the movable electrode, and the ink level is detected using signals sensed from the regions.

The signals sensed from the regions may be converted into on/off signals by comparing the sensed signals with a reference value, and the on/off signals may be directly used as discrete information for the ink level.

The foregoing and/or other aspects of the present general inventive concept may also be achieved by providing an ink level detecting apparatus usable in an image forming device, the apparatus including an ink tank including a shrinkable ink container containing ink, a first electrode disposed on the ink tank opposite the ink container, and a second electrode having a first end disposed on the shrinkable ink container and a second end disposed to face the first electrode such that the second electrode is movable with respect to the first electrode according to an amount of the ink contained in the ink container.

The foregoing and/or other aspects of the present general inventive concept may also be achieved by providing an ink amount detecting apparatus usable in an image forming device, the apparatus including an ink tank having a shrinkable ink container disposed therein, a first electrode disposed on the ink tank, and a second electrode disposed on the ink container, the first electrode and the second electrode relatively moving to change an overlap area therebetween representing an amount of the ink according to a movement of the ink container.

The foregoing and/or other aspects of the present general inventive concept may also be achieved by providing an image forming apparatus, including an ink cartridge having an ink tank with a shrinkable ink container containing ink, and an ink level detecting device to detect ink remaining in the ink container. The ink level detecting device includes a first electrode disposed on a first inner wall of the ink tank opposite the ink container, and a second electrode attached to the shrinkable ink container opposite the first electrode such that the second electrode is movable with respect to the first electrode as an amount of ink contained in the ink container decreases.

BRIEF DESCRIPTION OF THE DRAWINGS

These and/or other aspects of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1A:
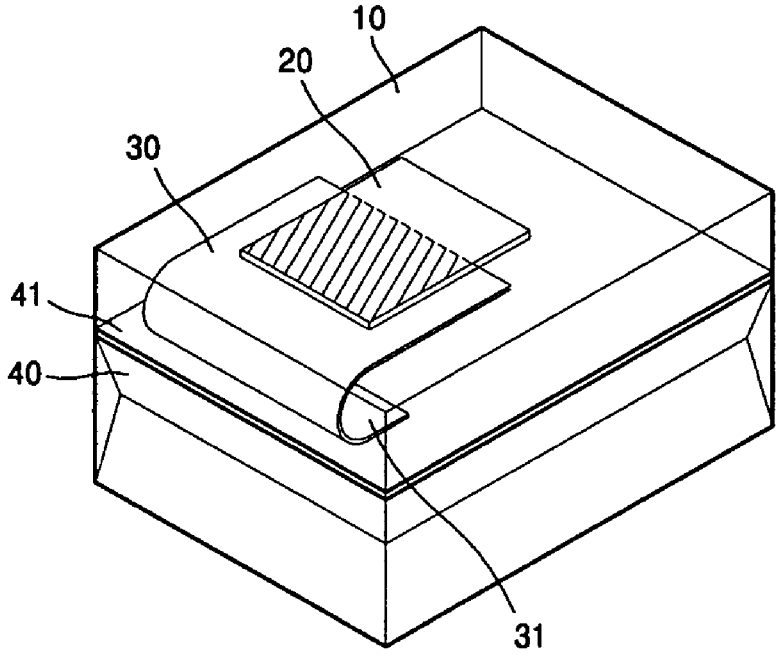
FIGS. 1A and 1B are perspective views illustrating a structure and operation of an ink level detecting apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 1B:
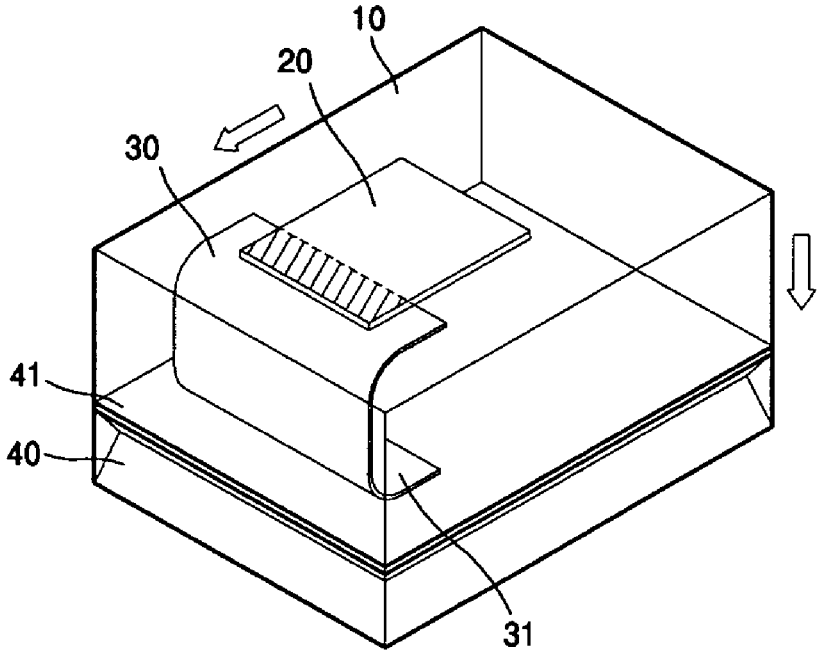

FIGS. 1A and 1B are perspective views illustrating a structure and operation of an ink level detecting apparatus according to an embodiment of the present general inventive concept. An ink tank 10 is illustrated only using contour lines to show an inside thereof. In an upper portion of the ink tank 10, a fixed electrode 20 and a movable electrode 30 are provided. The fixed and movable electrodes 20 and 30 are arranged such that an area of overlap between the two electrodes 20 and 30 varies depending on a displacement of the movable electrode 30. A vertical relationship between the fixed electrode 20 and the movable electrode 30 is not limited. The fixed electrode 20 and the movable electrode 30 can be placed on a ceiling of the ink tank 10, and/or under the ceiling, respectively, thereby making the ink tank 10 easy to assemble with the fixed and movable electrodes 20 and 30.

The ink tank 10 may be a housing accommodating a shrinkable ink pack 40. Although a shape of the ink tank 10 is not limited, a bottom, the ceiling, and a sidewall of the ink tank 10 may be closed. The ink tank 10 may be formed of various materials. The ink tank may be formed of plastic.

In the ink tank 10, the shrinkable ink pack 40 is provided. The shrinkable ink pack 40 defines an ink outlet (not shown) to supply ink to an ink ejection unit (not shown). As the ink is discharged through the ink outlet (not shown), the shrinkable ink pack 40 shrinks, and thus a top of the shrinkable ink pack 40 moves downward toward the bottom of the ink tank 10. The top and bottom of the shrinkable ink pack 40 may be formed of a film that is thicker than a side of the shrinkable ink pack 40 to keep the top and bottom flat. Alternatively, as illustrated in the present embodiment, a reinforcement plate 41 can be provided on the top of the shrinkable ink pack 40.

The movable electrode 30 may slide in the horizontal direction at a distance from the fixed electrode 20, and the horizontal distance that the movable electrode 30 moves may be proportional to a decrease of an ink level (i.e., the height variation of the shrinkable ink pack 40). The shrinkable ink pack 40 may be formed of laminated film having an aluminum layer. The shrinkable ink pack 40 may include the ink outlet (not shown) to discharge the ink and at least one wrinkle on a side to cause the top surface of the shrinkable ink pack 40 to be lowered when the ink decreases. Alternatively, a conventional ink pack having the above-mentioned features may be used for the shrinkable ink pack 40.

The fixed electrode 20 and the movable electrode 30 may form a capacitor having an electric capacity (i.e., a capacitance) that varies according to a variation of the overlap area between the two electrodes. The fixed and movable electrodes 20 and 30 may be formed of conductive electrode material. Particularly, the movable electrode 30 may be made with a film shaped flexible conductive material that bends along an inner wall of the ink tank 10. The film shaped flexible conductive material may be, for example, a metal thin plate, or a synthetic resin film having a metal thin film or a metal coating layer The movable electrode 30 extends along the sidewall of the ink tank 10, and the movable electrode 30 is bent in a C-shape with a front end 31 thereof connected to the top of the shrinkable ink pack 40. If the reinforcement plate 41 is provided on the top of the shrinkable ink pack 40, the front end 31 of the movable electrode 30 is connected to the reinforcement plate 41. Therefore, when the top of the shrinkable ink pack 40 is lowered as the amount of ink therein decreases, the movable electrode 30 moves along a guide structure 11 (see FIG. 2) formed on the top and the sidewall of the ink tank 10. As a result, the overlap area between the movable electrode 30 and the fixed electrode 20 also decreases.

Figure 2:
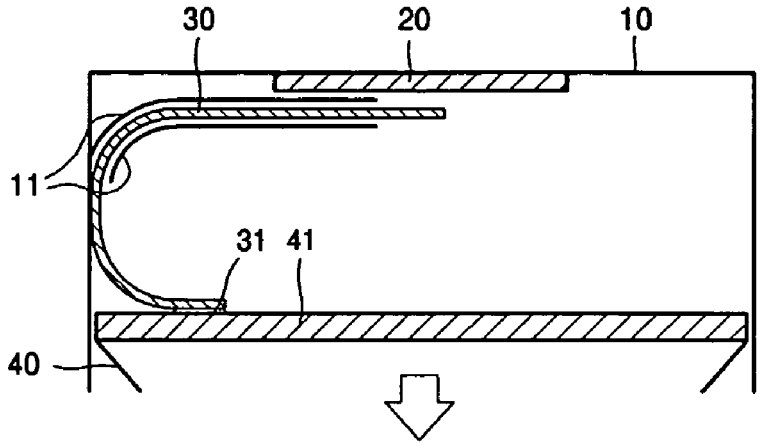
FIG. 2 is a partial side sectional view illustrating an upper portion of an ink tank of the ink level detecting apparatus of FIGS. 1A and 1B.

FIG. 2 is a partial side sectional view illustrating an upper portion of the ink tank 10 of FIGS. 1A and 1B. An example of the guide structure 11 is illustrated in FIG. 2. The guide structure 11 is provided in the upper portion of the ink tank 10 to allow the movable electrode 30 to slide in parallel with the fixed electrode 20. When the front end 31 of the movable electrode 30 that is fixed to the reinforcement plate 41 formed on the shrinkable ink pack 40 is pulled down in a vertical direction, the guide structure 11 guides the movable electrode 30 such that the movable electrode 30 can be smoothly moved in a horizontal direction. Further, the movable electrode 30 as it moves horizontally can maintain a constant distance (i.e., vertical distance) from the fixed electrode 20 at the overlap area due to the guidance of the guide structure 11. Since the movable electrode 30 is made of the film shaped flexible conductive material that is bendable, the movable electrode 30 can change shapes according to the guide structure 11 as the shrinkable ink pack 40 pulls the movable electrode 30 down, while maintaining the constant vertical distance from the fixed electrode 20.

Figure 3:
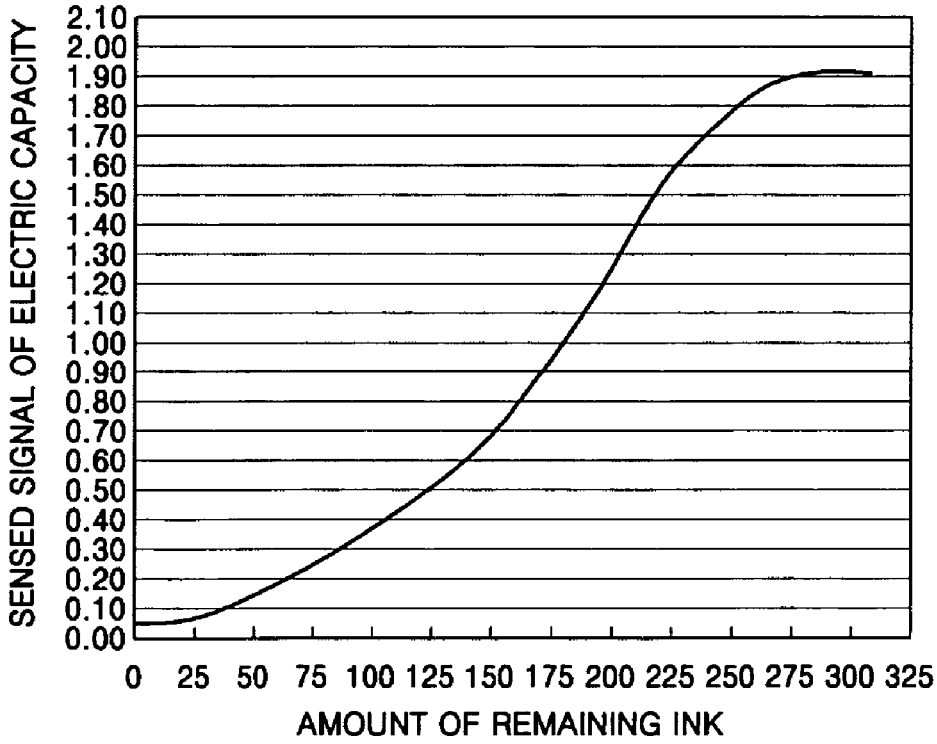
FIG. 3 is a graph illustrating a capacity signal level with respect to an actual ink level according to an embodiment of the present general inventive concept.

FIG. 3 is a graph illustrating a capacity signal level (i.e., the electric capacity) with respect to an actual ink level according to an embodiment of the present general inventive concept. The horizontal axis represents an amount of remaining ink (i.e., the ink level) that is actually measured, and the vertical axis represents a capacity sensor signal (i.e., a detected capacitance). As illustrated in the graph, the electric capacity between the fixed electrode 20 and the movable electrode 30 is approximately linearly proportional to the ink level. By using the relationship between the capacity sensor signal and the ink level illustrated in the graph, the ink level can be predicted from the capacity sensor signal without actual measurement of the ink level.

The electric capacity (C) of the capacitor may satisfy the following equation. $C=\in\cdot A/d$, where "A" represents the area of overlap between the fixed and movable electrodes 20 and 30, "d" represents the constant distance between the fixed and movable electrodes 20 and 30, and "$\in$" represents a dielectric constant between the fixed and movable electrodes 20 and 30. In the ink level detecting apparatus of the present embodiment, the overlap area (A) may vary in a linear proportion to the ink level such that the ink level is detected by electrically sensing the variation of the electric capacity (C). The electric capacity variation may be measured with a capacity meter (not shown) at, for example, the fixed electrode 20. Alternatively, the electric capacity variation may be measured using a value related with the electric capacity (C), such as an output voltage obtained from an alternating current input having a predetermined frequency, or the like.

If the electric capacity variation is continuously measured, the ink level can be detected by using the measured signal and a calibrated signal level versus ink level relationship such as the one illustrated in FIG. 3.

Figure 4:
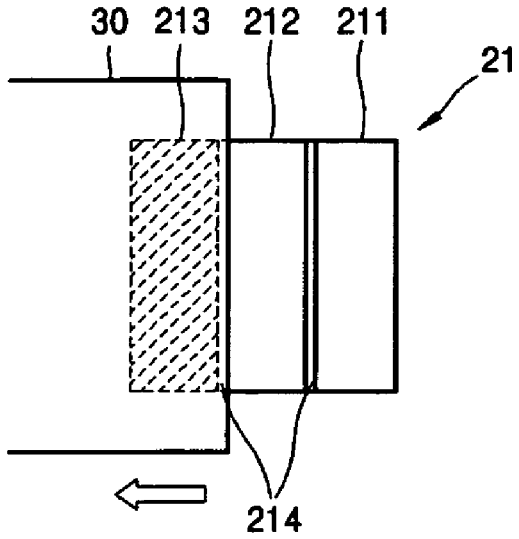
FIG. 4 is a schematic plan view illustrating a fixed electrode and a movable electrode of the ink level detecting apparatus of FIGS. 1A and 1B, according to another embodiment of the present general inventive concept.

FIG. 4 is a schematic plan view illustrating the ink level detecting apparatus having a fixed electrode and a movable electrode according to another embodiment of the present general inventive concept. The ink level detecting apparatus includes a fixed electrode 21 and a movable electrode 30, and one of these two electrodes is divided into a plurality of insulated regions. For example, according to the embodiment illustrated in FIG. 4, the ink level detecting apparatus includes the fixed electrode 21 divided into three regions. The fixed electrode 21 includes a first region 211, a second region 212, and a third region 213 that are arranged in a line along a moving direction of a movable electrode 30. The fixed electrode 21 further includes insulation gaps 214 between the regions 211, 212, and 213.

Other elements of the present embodiment, except the fixed electrode 21, are the similar to the elements of the embodiment of FIGS. 1A and 1B. As the movable electrode 30 moves depending on the height variation of a shrinkable ink pack (not shown), a number of regions of the fixed electrode 21 that overlap with the movable electrode 30 also varies. In FIG. 4, among the first, second, third regions 211, 212, and 213, only the third region 213 is overlapped with the movable electrode 30.

The regions are connected with signal lines, respectively. Each signal line provides a signal level sensed from the regions that can be converted into an ON/OFF signal by comparing the signal level with a reference level. That is, a position of the movable electrode 30 can be discontinuously detected through the number of the regions of the fixed electrode 21 that overlap with the movable electrode 30. In this case, the ON/OFF signal obtained from each region of the fixed electrode 21 can be directly used as ink level information.

Figure 5A:
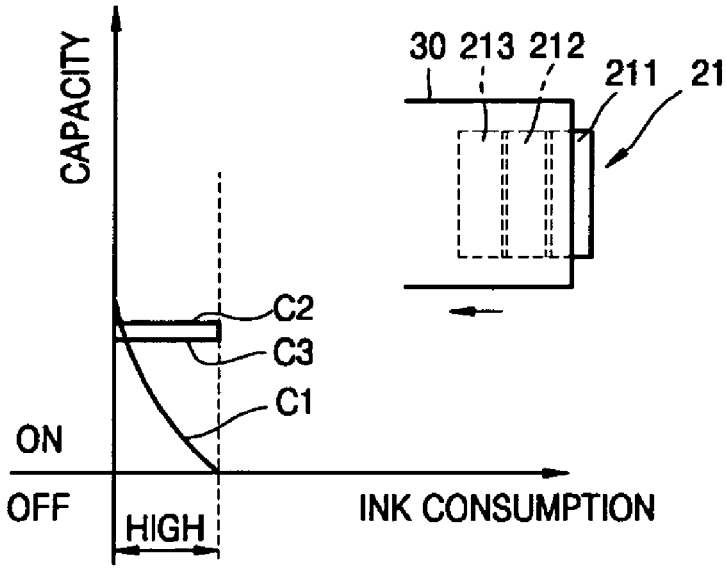
FIGS. 5A through 5C illustrate a variation of a detection signal depending on a position change of the movable electrode of FIG. 4.
Figure 5B:
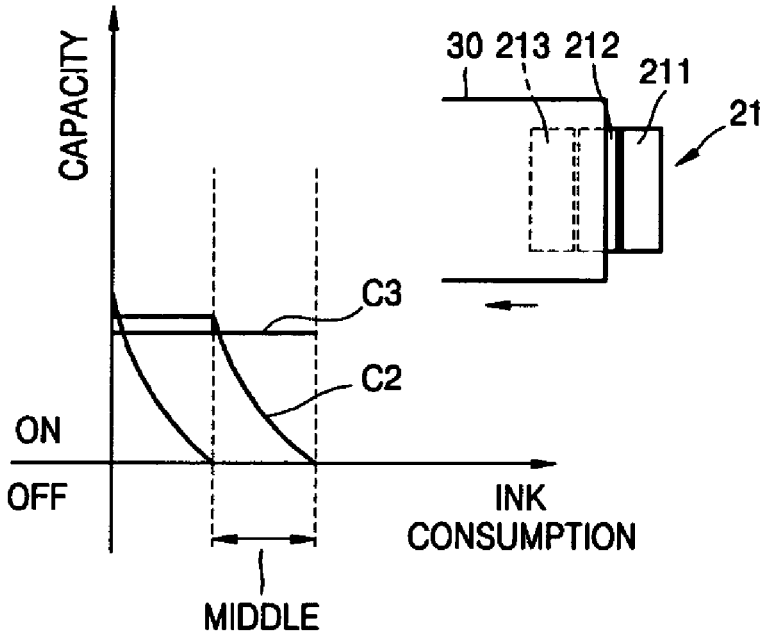
Figure 5C:
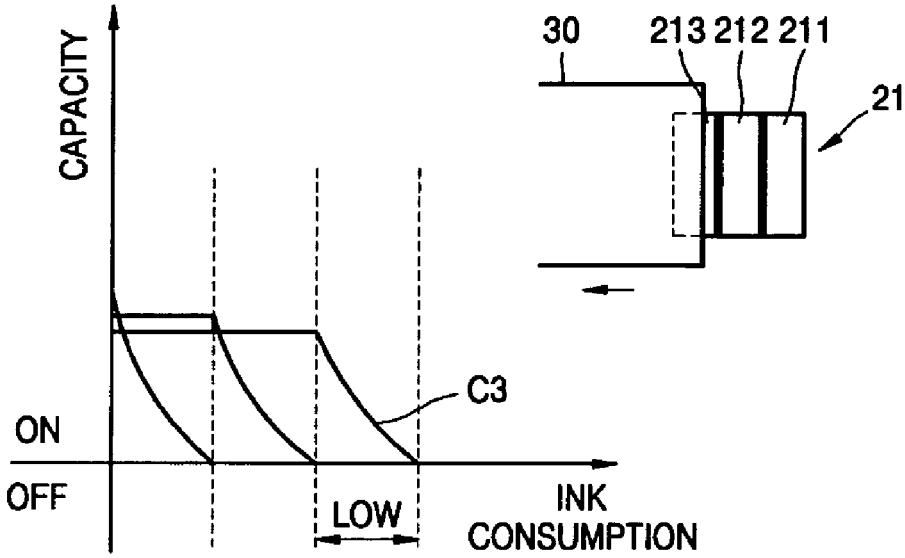

FIG. 5A through 5C illustrate a variation of sensed signal depending on a position change of the movable electrode 30 according to the embodiment of FIG. 4. Referring to FIG. 5A, when a back edge of the movable electrode 30 is located in the first region 211, ON signals are sensed from all the first, second, and third regions 211, 212, and 213. This indicates that the ink level is a high level. However, as the movable electrode 30 moves horizontally in the direction of the arrow, a capacity sensor signal level C1 of the first region 211 becomes lower. When the capacity sensor signal level C1 becomes lower than a predetermined reference level, an OFF signal is sensed from the first region 211.

Referring to FIG. 5B, when the back edge of the movable electrode 30 is located in the second region 212, ON signals are sensed from the second and third regions 212 and 213, and an OFF signal is sensed from the first region 211. This indicates that the ink level is a middle level. A capacity sensor signal level C3 of the third region 213 is kept at a maximum since the third region 213 is entirely overlapped with the movable electrode 30, and a capacity sensor signal level C2 of the second region 212 becomes lower.

Referring to FIG. 5C, when the back edge of the movable electrode 30 is located in the third region 213, an ON signal is sensed from only the third region 213. This indicates that the ink level is a low level. In this case, an alarming message can be sent to an output unit (not shown) to inform a user that the ink level is at the low level. As the ink is consumed, the movable electrode 30 is further moved in the direction of arrow to lower the capacity sensor signal level C3 of the third region 213. When the capacity sensor signal level C3 of the third region 213 becomes less than a reference level, an OFF signal is sensed from the third region 213.

A minimum amount of ink should be maintained in the ink tank (not shown) for protection of an ink ejection unit (not shown), or other reasons. Therefore, a size and location of the fixed electrode 21 is selected such that when the OFF signal is sensed from the third region 213, the minimum amount of ink is remaining in the ink tank.

When OFF signals are sensed from all the regions, an ink-jet printer may be controlled such that printing stops immediately or a next page is not printed. In the latter case, the amount of ink used to print the next page should be considered.

Although the embodiments of the present general inventive concept illustrate and describe electrodes being spaced apart vertically, it should be understood that this description is not intended to limit the scope of the present general inventive concept. For example, a first electrode may be disposed on an inner sidewall of an ink tank and a second electrode may be moved vertically with respect thereto to change an overlap region along a horizontal direction. Additionally, a guide structure may be used to facilitate this vertical movement. Also, a first electrode may be projected from an inner wall of the ink tank instead of being disposed flatly thereon.

As described above, an ink level detecting apparatus of the embodiments of the present general inventive concept includes an ink tank having a shrinkable ink pack. A top of the shrinkable ink pack is lowered as ink in the ink tank is consumed, and a height variation of the shrinkable ink pack is converted into an electrical signal in an approximately linear proportion. The electrical signal is used to detect the ink level in the ink tank. Therefore, the ink level can be detected more reliably.

Further, in an ink level detecting apparatus according to the various embodiments of the present general inventive concept, an electric signal that is responsive to a height variation of a shrinkable ink pack is simplified into several parts so that a stage of an ink level can be simply detected without comparison with the electric signal.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An ink level detecting apparatus usable in an ink-jet printer, the apparatus comprising:

an ink tank including a bottom, a ceiling, and a sidewall;

a shrinkable ink pack accommodated in the ink tank and including a top surface that moves down substantially evenly as an ink level therein decreases;

a fixed electrode disposed on an upper portion of the ink tank;

a movable electrode disposed on the shrinkable ink pack to face the fixed electrode at a predetermined distance from the fixed electrode to move in a horizontal direction according to a height variation of the top surface of the shrinkable ink pack such that an overlap area between the movable electrode and the fixed electrode varies; and a guide structure included with the ink tank to enable the movable electrode to slide in a direction that is parallel to the fixed electrode, and the movable electrode horizontally moves along the guide structure and includes a front end in the moving direction that flexibly extends along the ceiling and the sidewall of the ink tank and connected to the top surface of the shrinkable ink pack, wherein the ink level is detected from an electric capacity variation sensed between the fixed electrode and the movable electrode.

2. The ink level detecting apparatus of claim 1, wherein the shrinkable ink pack further comprises a reinforcement plate on the top surface of the shrinkable ink pack to keep the top surface flat.

3. The ink level detecting apparatus of claim 2, wherein a front end of the movable electrode is connected to the reinforcement plate.

4. The ink level detecting apparatus of claim 1, wherein the movable electrode comprises a film shaped flexible conductive material.

5. The ink level detecting apparatus of claim 1, wherein the ink level is continuously detected by comparing a signal sensed between the fixed and movable electrodes and a predefined signal level versus ink level relationship.

6. The ink level detecting apparatus of claim 5, wherein the signal sensed between the fixed and movable electrodes is an output voltage in response to an alternating current input having a predetermined frequency.

7. An ink level detecting apparatus usable with an ink-jet printer, the apparatus comprising:

an ink tank including a bottom, a ceiling, and a sidewall;

a shrinkable ink pack accommodated in the ink tank and including a top surface that moves down substantially evenly as an ink level in the shrinkable ink pack decreases;

a fixed electrode installed to an upper portion of the ink tank; and a movable electrode attached to the ink pack and disposed to face the fixed electrode at a predetermined distance from the fixed electrode to move in a horizontal direction according to a height variation of the top surface of the shrinkable ink pack such that an overlap area between the movable electrode and the fixed electrode varies, wherein one of the fixed electrode and the movable electrode is divided into a plurality of insulated regions such that the number of the regions overlapping with the other electrode varies depending on the movement of the movable electrode, and the ink level is detected using signals sensed from the regions.

8. The ink level detecting apparatus of claim 7, wherein the ink tank further comprises a guide structure to enable the movable electrode to slide in a direction that is parallel to the fixed electrode, and the movable electrode horizontally moves along the guide structure and includes a front end in the moving direction that extends along the ceiling and the sidewall of the ink tank and connected to the top surface of the shrinkable ink pack.

9. The ink level detecting apparatus of claim 7, wherein the shrinkable ink pack further comprises a reinforcement plate on the top surface of the shrinkable ink pack to keep the top surface flat.

10. The ink level detecting apparatus of claim 9, wherein a front end of the movable electrode is connected to the reinforcement plate.

11. The ink level detecting apparatus of claim 7, wherein the movable electrode comprises a film shaped flexible conductive material.

12. The ink level detecting apparatus of claim 7, wherein the fixed electrode comprises the plurality of regions arranged in the moving direction of the movable electrode, and the ink level is discontinuously detected using on/off signals sensed from each of the regions.

13. The ink level detecting apparatus of claim 12, wherein each of the on/off signals is obtained by comparing an output voltage from an alternating current input having a predetermined frequency with a reference voltage.

14. An ink level detecting apparatus usable in an image forming device, the apparatus comprising:

an ink tank including a shrinkable ink container containing ink;

a first electrode disposed on the ink tank opposite the ink container;

a second electrode having a first end disposed on the shrinkable ink container and a second end disposed to face the first electrode such that the second electrode is movable with respect to the first electrode according to an amount of the ink contained in the ink container; and a guide unit attached to the ink tank to guide movement of the second end of the second electrode such that the second electrode is maintained a constant predetermined distance from the first electrode when an overlap area between the first electrode and the second end of the second electrode varies.

15. The apparatus of claim 14, wherein the second electrode comprises a flexible conductive material, the guide unit is attached to an inner wall, the guide unit having a bent shape to guide movement of the second electrode such that an overlap area between the first electrode and the second end of the second electrode is changed while a constant predetermined distance therebetween is maintained.

16. The apparatus of claim 14, wherein the shrinkable ink container comprises a reinforcement plate disposed on a top surface thereof to which the first end of the second electrode is attached.

17. The apparatus of claim 14, wherein the amount of ink contained in the shrinkable ink container is measured by detecting a capacitance between the first electrode and the second end of the second electrode as a function of an overlap area therebetween.

18. The apparatus of claim 17, wherein the amount of ink is linearly proportional to the detected capacitance between the first electrode and the second end of the second electrode.

19. The apparatus of claim 14, wherein the amount of ink contained in the shrinkable ink container is measured by detecting a capacitance according to $C=\in\cdot A/d$, where "A" represents an area of overlap between the first and second electrodes, "d" represents a constant distance between the first and second electrodes, and "$\in$" represents a dielectric constant between the first and second electrodes.

20. The apparatus of claim 14, wherein one of the first and second electrodes is divided into a plurality of conductive regions that are insulated from one another such that a capacitance signal is detected between each of the respective conductive regions and the other one of the first and second electrodes.

21. The apparatus of claim 14, wherein the second end of the second electrode is divided into a plurality of conductive regions that are insulated from one another such that a capacitance signal is detected between each of the respective conductive regions and the first electrode.

22. The apparatus of claim 21, wherein the conductive regions comprise a first region that corresponds to a high level amount of ink, a second region that corresponds to a middle level amount of ink, and a third region that corresponds to a low level amount of ink.

23. An ink amount detecting apparatus usable in an image forming device, the apparatus comprising:

an ink tank having a shrinkable ink container disposed therein to contain ink;

a first electrode disposed on the ink tank; and a second electrode disposed on the ink container, and having a first end disposed to have a distance with the first electrode and a second end disposed to have an overlap area with the first electrode, such that the overlap area represents an amount of the ink contained in the ink container, wherein the second end of the second electrode is spaced apart from the first electrode by a second distance, the distance is variable according to an amount of the ink, and the second distance is constant regardless of an amount of the ink.

24. The apparatus of claim 23, wherein the first end of the second electrode moves with respect to the first electrode in a first direction, and the second end of the second electrode moves with respect to the first electrode in a second direction.

25. The apparatus of claim 23, wherein the distance of the first end of the second electrode with the first electrode and the overlap area of the second end of the second electrode with the first electrode vary according to an amount of the ink of the ink container.

26. The apparatus of claim 23, wherein the second end of the first electrode is disposed to face and cover a portion of the first electrode as the overlap area.

27. The apparatus of claim 23, wherein the first end of the second electrode is disposed not to overlap the first electrode.

28. The apparatus of claim 23, wherein:

the second electrode has an area as a sum of a variable area of a portion of the second electrode that is adjacent to the first end and a variable area of a portion of the second electrode that is adjacent to the second end; and the variable area of the first end increases when the variable area of the portion of the second electrode that is adjacent to the second end that corresponds with the overlap area decreases, according to an amount of the ink contained in the ink container.

29. The apparatus of claim 23, wherein:

the first electrode has a first area; and the second electrode has a second area larger than the first area.

30. The apparatus of claim 23, wherein:

the first electrode has a first area;

the second electrode has a second area as a sum of a variable area of a portion of the second electrode that is adjacent to the first end and a variable area of a portion of the second electrode that is adjacent to the second end; and the variable area of the portion of the second electrode that is adjacent to the first end increases as the overlap area decreases, according to an amount of the ink contained in the ink container.

* * * * *